US006393765B1

(12) United States Patent
Goldstein et al.

(10) Patent No.: US 6,393,765 B1
(45) Date of Patent: May 28, 2002

(54) SUPERELASTIC SEALING CLOSURES

(75) Inventors: David Goldstein, Potomac; Joseph P. Teter, Mt Airy, both of MD (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/644,658

(22) Filed: Aug. 24, 2000

(51) Int. Cl.[7] ..... E06B 7/16
(52) U.S. Cl. ..... 49/475.1; 49/489.1
(58) Field of Search ..... 49/475.1, 440, 49/489.1, 498.1

(56) References Cited

U.S. PATENT DOCUMENTS 5,375,376 A * 12/1994 Scott ..... 49/480.1
5,528,863 A * 6/1996 Scott ..... 49/480.1
5,592,782 A * 1/1997 Scott ..... 49/489.1
5,766,237 A * 6/1998 Cragg ..... 623/1
5,979,828 A * 11/1999 Gruensfelder et al. ... 244/129.1
6,009,669 A * 1/2000 Jardine et al. ..... 49/316
6,108,978 A * 8/2000 Jeong ..... 49/440
6,258,182 B1 * 7/2001 Schetky et al. ..... 148/402
6,312,461 B1 * 11/2001 Unsworth et al. ..... 623/1.19
6,315,708 B1 * 11/2001 Salmon et al.
6,315,791 B1 * 11/2001 Gingras et al. ..... 623/1.13

* cited by examiner

*Primary Examiner*—Curtis Cohen
(74) *Attorney, Agent, or Firm*—Jacob Shuster

(57) ABSTRACT

A closure system including a rigid structural part has an edge surface along which sealage is established in response to deformation of a superelastic sheet metal element positioned thereon, such sheet metal element being endowed with a shape memory characteristic by formation as a Nitinol alloy to meet high sealage standards and other environmental requirements.

9 Claims, 4 Drawing Sheets

STRESS
(MPα)
1500
1000
500
0
12
10
0
1
2
3
4
5
6
7
8
STRAIN (%)

18
24
14
16
20
18'
22
16
14

FIG. 2A
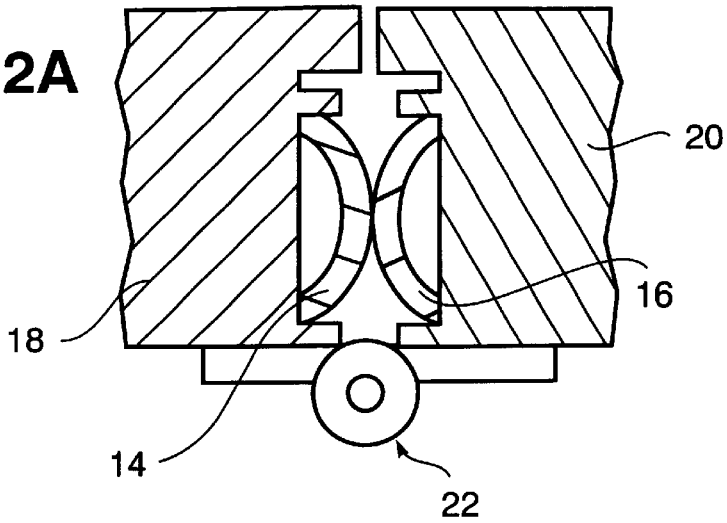
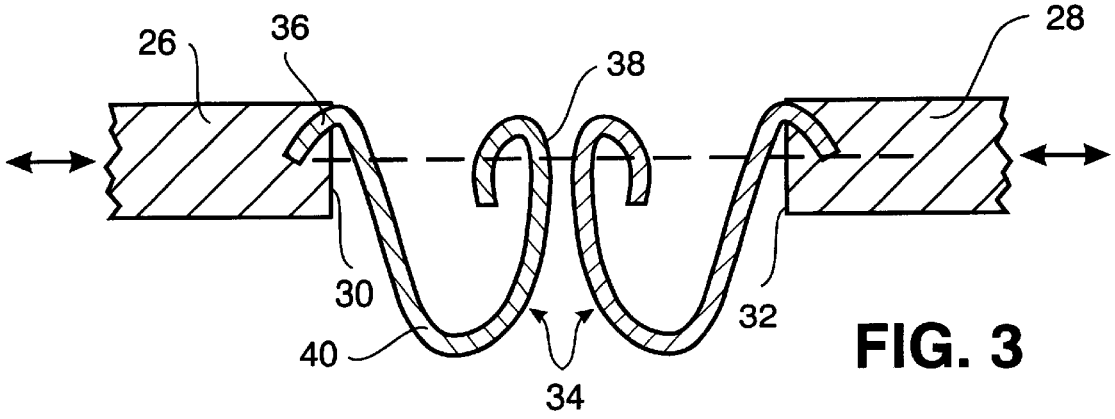
FIG. 3
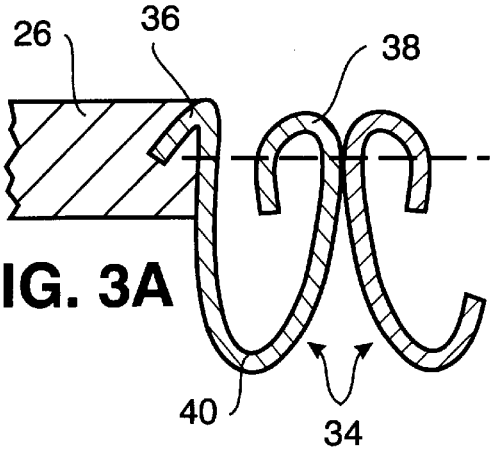
FIG. 3A
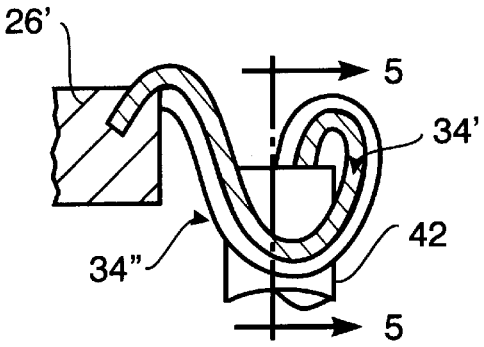
FIG. 4

SUPERELASTIC SEALING CLOSURES

The present invention relates generally to sealing closures such as those associated with hangar doors and hatches onboard marine vessels.

BACKGROUND OF THE INVENTION

Hatches and door openings on board ships sometimes require watertight sealage to meet high performance standards, as well as other design requirements such as non-flammability, corrosion, fuel and chemical resistances and prolonged impact resistance. Current closure sealing systems do not accommodate many of such closure sealing requirements.

Presently available advancements in the fabrication of superelastic metals, allow for manufacture of such metals directly into sheet form, with the required strength, dimensions and configurations for closure sealing applications. It is therefore an important object of the present invention to provide a closure sealing system utilizing the superelastic properties of such sheet metals for watertight sealing purposes or the like with improved high standards to meet a wide variety of current design requirements.

SUMMARY OF THE INVENTION

In accordance with the present invention, the composition of a shape memory sheet metal material is selected to provide superelastic properties for improved closure sealing purposes without externally imposed control. Such selected metal involves Nitinol alloying by undergoing thermo-mechanical treatments already known in the art resulting in load elongation characteristic accommodating the establishment of closure systems providing the desired sealage conditions such as watertightness onboard ships as well as to deal with other associated environmental hazards. Such closure systems involve positioning of the selected sheet metal by direct attachment onto the edge surfaces of rigid structural parts of a closure arrangement, as seal elements to be deformed by engagement in response to closure displacement.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein:

FIGS. 2 and 2A are partial section views illustrating a closure sealing arrangement in accordance with one embodiment of the present invention;

FIGS. 3 and 3A are partial section views illustrating a second embodiment;

FIG. 4 is a partial section view illustrating a modification of the embodiment shown in FIGS. 3 and 3A;

DETAILED DESCRIPTION OF THE PREFERRED EMBODIMENTS

Figure 1:
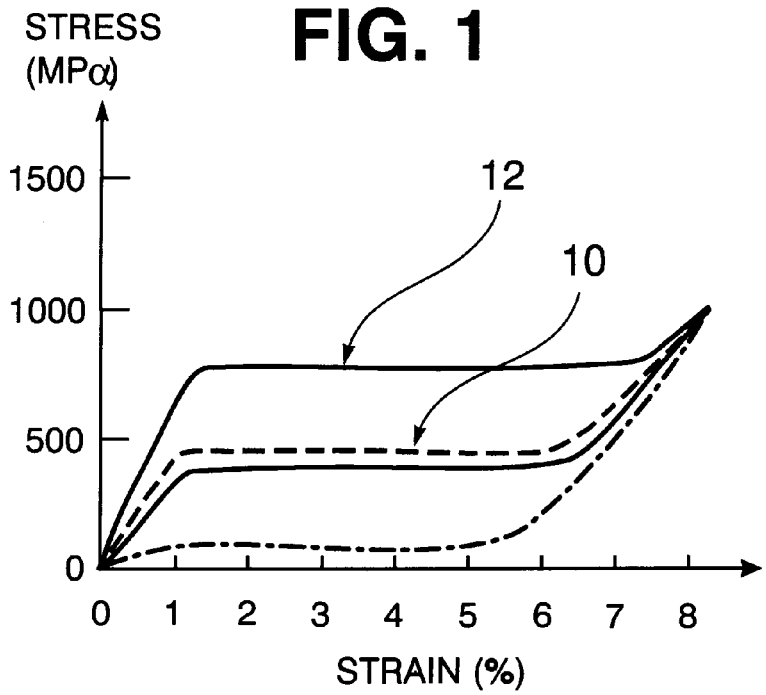
FIG. 1 is a graphical representation of the superelastic phenomenon associated with shape memory metallic alloys selected for use in accordance with the present invention.

Referring now to the drawing in detail, FIG. 1 graphically diagrams physical properties of a superelastic shape memory material selected for use pursuant to the present invention. Such superelastic material, as generally known in the art, is formed from a Nitinol metal which had thermo-mechanical treatments so as to exhibit 6% elasticity via a change of atomic structure during deformation. Such superelasticity phenomena as depicted in FIG. 1, for a Nitinol metal which undergoes an 8% change in strain as represented along the abscissa, during change in stress applied thereto as represented along the ordinate of the graph. A graphical curve 10 in FIG. 1 for a particular composition with Austenite finish of about 0° C. thus depicts a 5% change in strain during deformation under a stress of approximately 400 MPa imposed at a temperature of 10° C., while the graphical curve 12 depicts a 5% change in strain during a deformation stress of approximately 700 MPa imposed at a temperature of 50° C. The selected sheet material is furthermore non-flammable, corrosion resistant, fuel and chemical resistant and long-lived deformation resistant.

Figure 2:
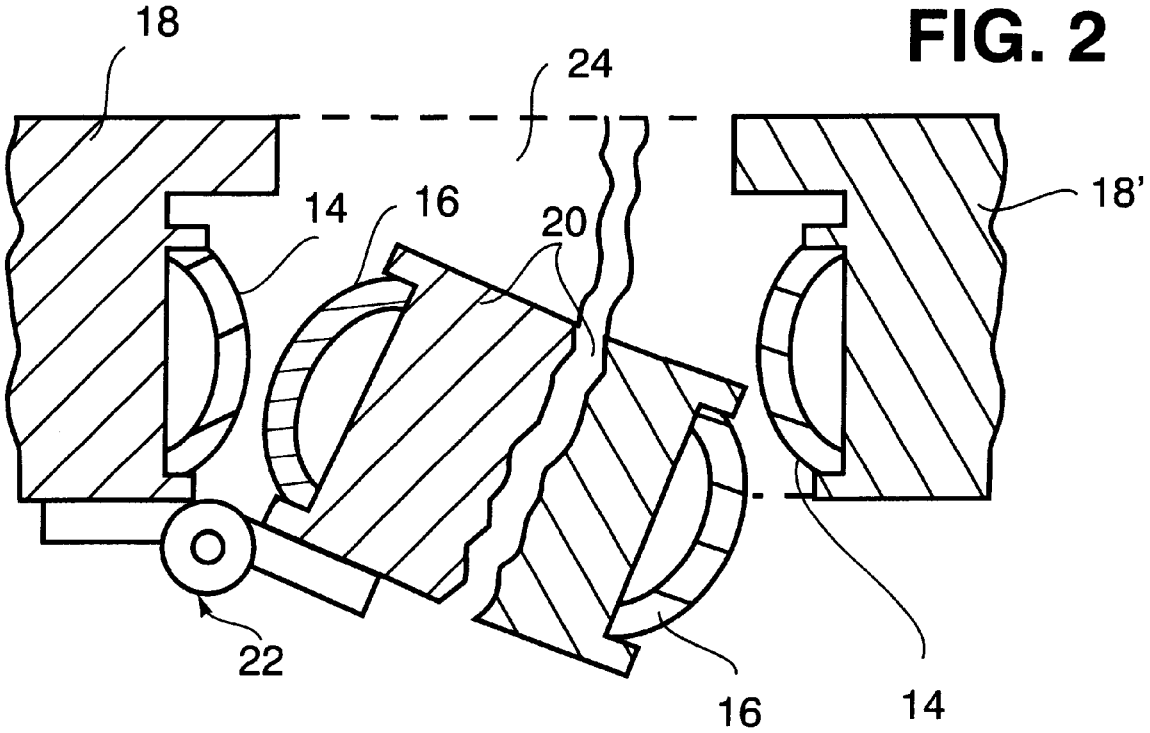

FIGS. 2 and 2A illustrate use of the selected superelastic sheet material for door hatch purposes in the form of matching seal strip elements 14 and 16 of cross-sectionally arcuate shape respectively positioned on confronting edges of a stationary, rigid door frame section 18 and a rigid door panel 20 pivotally mounted on the frame 18 by conventional hinges 22. In an open position of the door panel 20 as shown in FIG. 2, the seal strips 14 and 16 are in closely spaced angular relationship to each other. When the door panel 20 is pivotally displaced to its closed position as shown in FIG. 2A, the seal strip elements 14 and 16 are in contact with each other under deformation in the direction of compressive strain corresponding to watertight sealing engagement between the closely spaced confronting edges of the hingedly connected door frame section 18 and door panel 20.

As also shown in FIG. 2, the edge of the door panel 20 opposite the edge at which the hinges 22 are located, is also provided with a seal strip element 16 matching seal strip element 14 also positioned on the edge of the door frame section 18' in alignment with the hinge mounting door frame section 18, so as to form a door opening 24 therewith. Such door opening is substantially closed by the door panel 20 when pivotally displaced to the closed position shown in FIG. 2A, bringing the other pair of matching seal strip elements 14 and 16 into the same watertight sealing engagement condition as hereinbefore described with respect to FIG. 2A. A watertight sealed closure is thereby established between the door panel 20 and the door frame sections 18 and 18'.

FIG. 3 illustrates by way of example a pair of movable rigid door panel sections 26 and 28 having confronting edges 30 and 32 on which a pair of matching compression seal elements 34 are mounted. Each seal element 34 is cross-sectionally profiled so as to include at one end an edge portion 36 fixedly attached to its door section 26 or 28. The seal element 34 also includes compressible loop portion 38 at its other end interconnected by an intermediate gutter portion 40 to the portion 36 attached to the door panel section. With the door panel sections 26 and 28 displaced toward each other from the positions shown in FIG. 3 to a closure position, the loop portions 38 of the seal elements 34 are in deformed contact engagement with each other as shown in FIG. 3A to establish the watertight sealing condition. In addition to establishment of such watertight sealing condition, the profiling of the matching pair of compression seal elements 34 by including the gutter portions 40, may collect and accommodate water run off.

Figure 5:
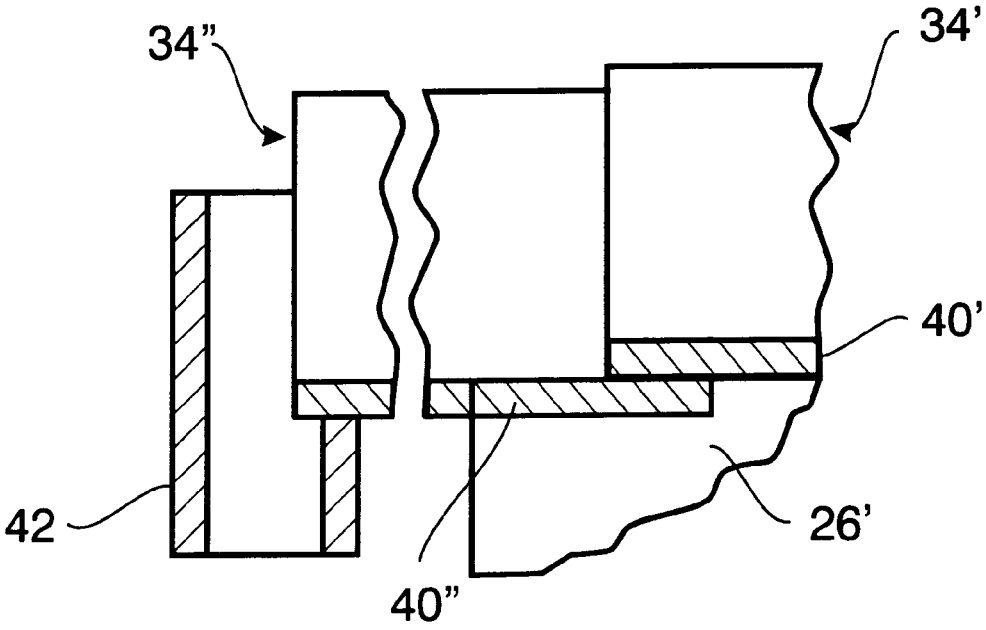
FIG. 5 is a partial section view taken substantially through a plane indicated by section line 5—5 in FIG. 4.

The compression seal elements 34 as shown in FIGS. 3 and 3A are of a length perpendicular to their profiled cross-sections corresponding to the length of the edges of the door panel sections 26 and 28 on which they are mounted. In order to accommodate longer edged door panel sections 26', overlapping profiled seal elements 34' and 34" may be attached by spot if welding thereto as shown in FIGS. 4 and 5. In such case, a drain 42 would be positioned at one end of the underlying seal element 34" beyond the edge of the door panel section 26' in order to receive run-off drainage flow from the gutter portions 40' and 40".

Figure 6:
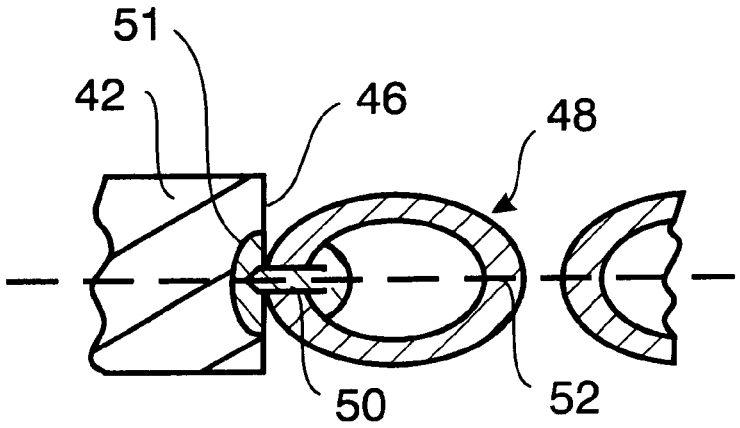
FIG. 6 is a partial section view illustrating a third embodiment.

FIG. 6 illustrates yet another sealing hatch type of closure arrangement between relatively movable rigid door panels and/or door frames such as the door panel 44 having an edge 46 to which is attached a compression seal element 48 made of the selected superelastic sheet material. The seal element 48 is of an oval shape in cross-section, with a slit 50 at one end through which it is attached by suitable means such as continuous molding (5) to the door panel edge 46. At the other cross-sectional end 52 of the seal element 48 it is engageable by a matching seal element for watertight sealing purposes as hereinbefore described.

Figure 7:
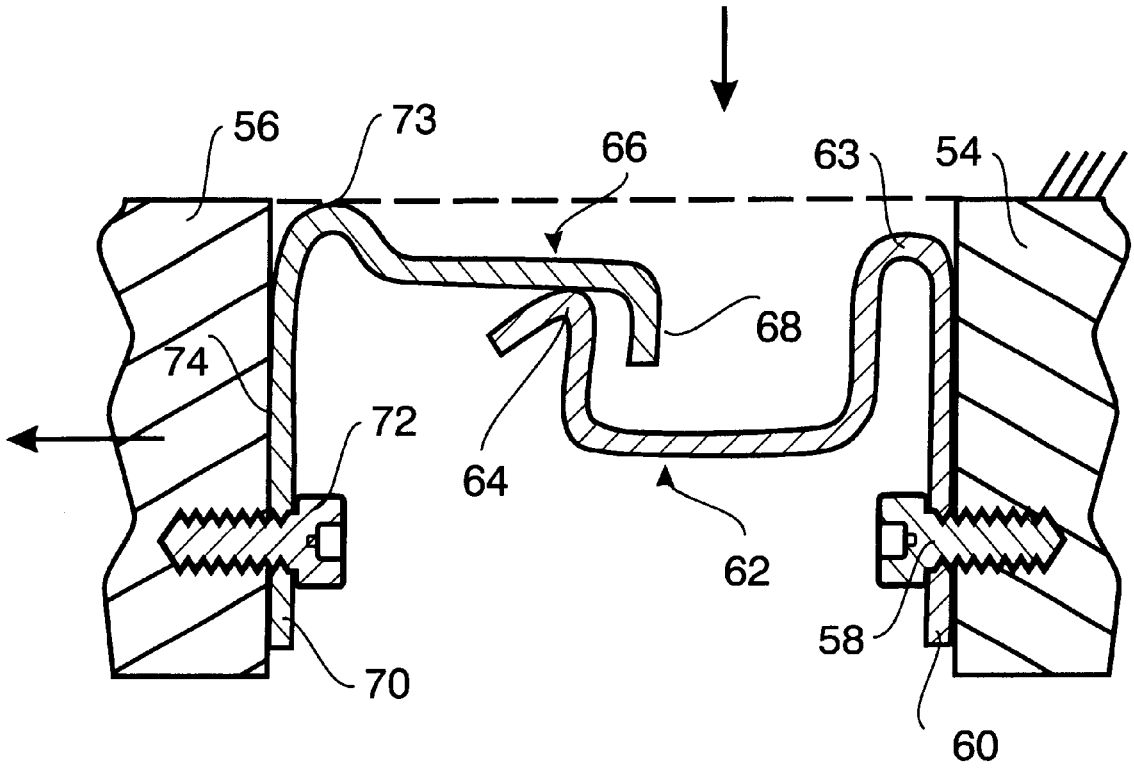
FIGS. 7 and 7A are partial section views illustrating a fourth embodiment of the present invention.
Figure 7A:
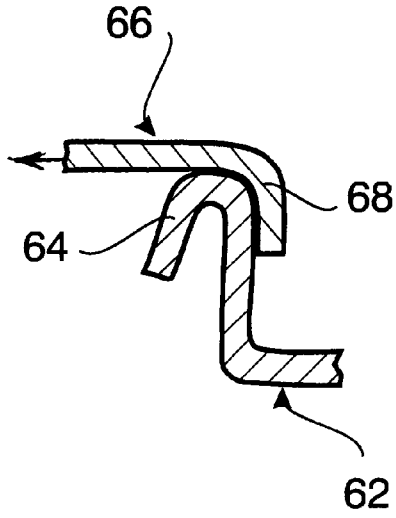

Finally, yet another embodiment is illustrated in FIGS. 7 and 7A, for establishing a watertight sealing condition between a rigid frame section 54 and a relatively displaceable hatch panel 56. Secured to the edge surface of the frame section 54 by means of an attachment bolt 58 is a flat end portion 60 of a lip seal element 62 connected by a loop portion 63 to a curved end portion 64 in sliding contact with another lip seal element 66 in close spaced relation to its curved end portion 68. The other flat end portion 70 of the lip seal element 66, connected to a loop portion 73 of the element 66, is secured by an attachment bolt 72 to the abutting edge surface 74 of the hatch panel 56. When the hatch panel 56 is displaced to a hatch sealing position, the curved end portion 68 of its lip seal element 66 is in sealing contact with the curved end portion 64 of the lip element 62 as shown in FIG. 7A so as to establish the watertight sealing condition.

In each of the foregoing described embodiments, two metal sheet seal elements act against each other for watertight sealing of openings associated with hanger doors and hatches on board ships under conditions and with advantages made possible by the superelastic properties of the selected Nitinol alloyed metallic composition of such seal elements which are lighter than steel while having comparable design strength. In view of their metallic composition, the sheet seal elements are also capable of sealing out electromagnetic interference. The concepts embodied in the described embodiments are also potentially applicable to other closure devices, such as sliding and turnstile doors, water canal doors, radiation chamber closures and non-magnetic signature doors. Further, an elastomer coating may be applied to the superelastic metallic sheet seal elements to accommodate other environments which include for example dusts, fumes, gasses and small particles of debris.

Obviously, other modifications and variations of the present invention may be possible in light of the foregoing teachings. It is therefore to be understood that within the scope of the appended claims the invention may be practiced otherwise than as specifically described.

What is claimed is:

1. In a closure arrangement including a structural part, a sheet metal element directly attached to the structural part; and sealing means engageable with said element for deformation in response to a change in temperature; said sheet metal element being a shape memory metal selected for endowment thereof with superelastic properties to establish improved sealage conditions by said deformation,without external control.

2. The closure arrangement as defined in claim 1, wherein said sheet metal element is made exclusively from a shape memory alloy through which said superelastic properties of the memory characteristic is selected.

3. The closure arrangement as defined in claim 2, wherein the sheet metal element includes an arcuate contact portion at which contact engagement with the sealing means occurs.

4. The closure arrangement as defined in claim 3, wherein said structural part is a rigid door section on which an edge surface is formed and to which the sheet metal element is secured; said arcuate contact portion of the element being spaced from the edge surface in a direction of said deformation thereof by the sealing means.

5. The closure arrangement as defined in claim 4, wherein the sealing means includes another matching sheet metal element.

6. The closure arrangement as defined in claim 5, wherein said matching sheet metal elements respectively include attachment end portions, loop-shaped ends on which the contact portions are formed and gutter shaped intermediate portions interconnecting the attachment end portions and the loop-shaped ends of the respective elements.

7. The closure arrangement as defined in claim 1, wherein said sheet metal element is of cross-sectionally oval shape.

8. The closure arrangement as defined in claim 1, wherein the sheet metal element includes an attachment end portion secured to the structural part, and a loop-shaped end on which a contact portion is formed.

9. The closure arrangement as defined in claim 1, wherein said structural part is a rigid door section on which an edge surface is formed and to which the sheet metal element is secured; said sheet metal element having an arcuate contact portion spaced from the edge surface in a direction of said deformation thereof by the sealing means.

* * * * *